US006672828B2

(12) United States Patent
Cerruti

(10) Patent No.: US 6,672,828 B2
(45) Date of Patent: Jan. 6, 2004

(54) VACUUM PUMP

(75) Inventor: Roberto Cerruti, Turin (IT)

(73) Assignee: Varian S.p.A., Turin (IT)

( * ) Notice: Subject to any disclaimer, the term of this patent is extended or adjusted under 35 U.S.C. 154(b) by 21 days.

(21) Appl. No.: 10/162,145

(22) Filed: Jun. 3, 2002

(65) Prior Publication Data

US 2003/0223860 A1 Dec. 4, 2003

(51) Int. Cl.[7] ..... F03D 5/00

(52) U.S. Cl. ..... 415/90; 415/55.1; 416/175; 416/198 R; 417/89; 417/201; 417/205

(58) Field of Search ..... 415/90, 55.1, 143; 416/175, 198 R, 198 A, 203; 417/87, 88, 89, 201, 205, 423.4

(56) References Cited

U.S. PATENT DOCUMENTS 3,536,418 A * 10/1970 Breaux ..... 417/49
4,797,068 A 1/1989 Hayakawa et al.
5,118,251 A 6/1992 Sauigeot
5,197,861 A * 3/1993 Maruyama et al. ..... 417/42
5,238,362 A 8/1993 Casaro et al.
5,611,673 A * 3/1997 Agata ..... 417/198
6,083,384 A * 7/2000 Al-Ali ..... 210/175

FOREIGN PATENT DOCUMENTS

EP 0 340 685 A2 11/1989

* cited by examiner

*Primary Examiner*—Edward K. Look
*Assistant Examiner*—Dwayne J. White
(74) *Attorney, Agent, or Firm*—Bella Fishman

(57) ABSTRACT

A turbomolecular vacuum pump (5) comprises a first pumping section (1) having pumping stages with bladed rotor discs, a second pumping section (2) having pumping stages with smooth rotor discs, a third pumping section (3) having a pumping stage with a toothed rotor disc (26), and a fourth pumping section (4) of the ejector or venturi pump type. (FIG. 1*a*)

10 Claims, 4 Drawing Sheets

VACUUM PUMP

FIELD OF THE INVENTION

The present invention relates to an improved vacuum pump.

More particularly, the invention relates to a turbomolecular vacuum pump with a particularly high compression ratio, capable of exhausting at atmospheric pressure.

BACKGROUND OF THE INVENTION

Turbomolecular pumps are known which comprise pumping stages with plane or bladed rotors, see for instance U.S. Pat. No. 5,238,362 entitled "Turbomolecular Pump" issued Oct. 26, 1994.

Conventional turbomolecular pumps have rather limited operation ranges. They cannot reach a pressure difference between the inlet and outlet ducts to allow exhaust at atmospheric pressure. Though considerable advances have been made in recent years in pump technology, resulting in the development of turbomolecular pumps allowing exhaust at substantially higher pressures, it is still necessary to provide a so-called fore-pump that is coupled with the turbomolecular pump.

Fore-pumps are coupled outside the turbomolecular pump and their interconnection require gas flow ducts. Moreover, the electrical supply is provided by the same control unit as that supplying the turbomolecular pump. The fore-pump pressure makes the pumping system complex and more subject to failures.

A vacuum generating system, comprising a molecular pump coupled with a fore-pump, is disclosed in U.S. Pat. No. 4,797,068 entitled "Vacuum Evacuation System" issued Jan. 10, 1989. According to the teaching that patent, the exhaust port of a molecular rotary pump, comprising a plurality of pumping stages defined by the coupling of a rotor and a stator, is directly connected with a suction duct of a screw pump. The discharge port of the screw pump exhausts at atmospheric pressure.

The system is characterised by a structural complexity. The system needs two separate electric motors, since the pumps are to rotate at very different speeds. Moreover, even if the fore-pump is equipped with a seal assembly arranged to prevent lubricant from entering the pumping chamber, the molecular pump is subjected to pollution in case of failures or poor maintenance.

Ejector or venturi pumps are also known which are actuated by a first, high-pressure fluid and suck a second, low-pressure fluid thereby generating an intermediate pressure level at the outlet. Both the first and the second fluid can indiscriminately be either a liquid or a gas for instance, by feeding the pump with pressurised water, it is possible to suck a gas such as air, thereby generating a low pressure in a closed space and creating a fore-vacuum condition.

Ejector or venturi pumps, of a kind suitable for sucking a gas, generally can work starting from pressures of about 30 millibars.

Therefore, there is a need to provide a turbomolecular pump capable of exhausting at atmospheric pressure.

SUMMARY OF THE INVENTION

The present invention provides a turbomolecular vacuum pump comprising, starting to from the inlet port, a first pumping section having pumping stages with bladed rotor discs, a second pumping section having pumping stages with smooth rotor discs, a third pumping section having at least one pumping stage with toothed rotor disc, and a fourth ejector or venturi pumping section.

According to the present invention, optimised progressive pumping stages are provided in the turbomolecular pump, capable of bringing the exhaust pressure of the turbomolecular pump to a level suitable for the operation of an ejector or venturi pump, typically 30 mbar.

According to the present invention, the turbomolecular pump is capable of exhausting at a pressure of about 100 mbar already at the third stage.

By using a vacuum pump made in accordance with the invention, in particular with a third pumping stage having a rotor disc with straight teeth, an energy saving can be achieved.

Indeed, at the exhaust pressure of 30 mbars it has been experienced that the pump having a pumping stage with toothed rotor has lower electric current absorption than a pump not equipped with a stage with toothed rotor disc.

The vacuum pump according to the present invention can be used in all applications where a high vacuum condition is required in particularly clean environments, such as for instance in semiconductor working processes.

The above and other advantages of the present invention will become more apparent from the description of a preferred embodiment, with reference to the accompanying drawings.

DETAILED DESCRIPTION OF THE INVENTION

Figure 1A:
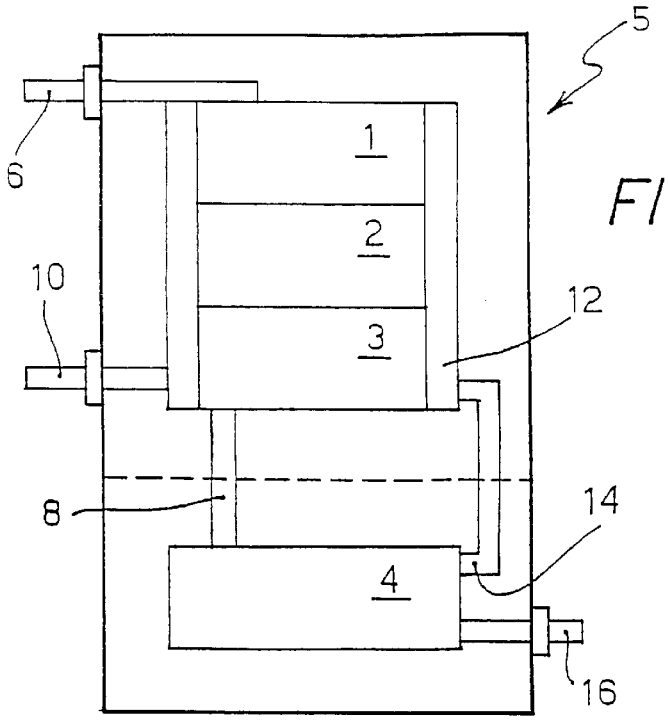
FIG. 1*a* is a schematical view of a turbomolecular vacuum pump made in accordance with a first embodiment of the present invention.

Referring to FIG. 1*a*, a vacuum pump 5, according to a first exemplary embodiment, comprises four different pumping sections 1, 2, 3 and 4, arranged between a suction duct 6 and an exhaust duct 16. The first three sections are part of a turbomolecular pump, comprising a rotor 20, shown in detail in FIG. 2, and equipped with a plurality of pumping stages defined by rotor discs 22*a*–22*h*, 24*a*–24*f* and 26, coupled with stator rings, not shown in FIG. 2.

Figure 2:
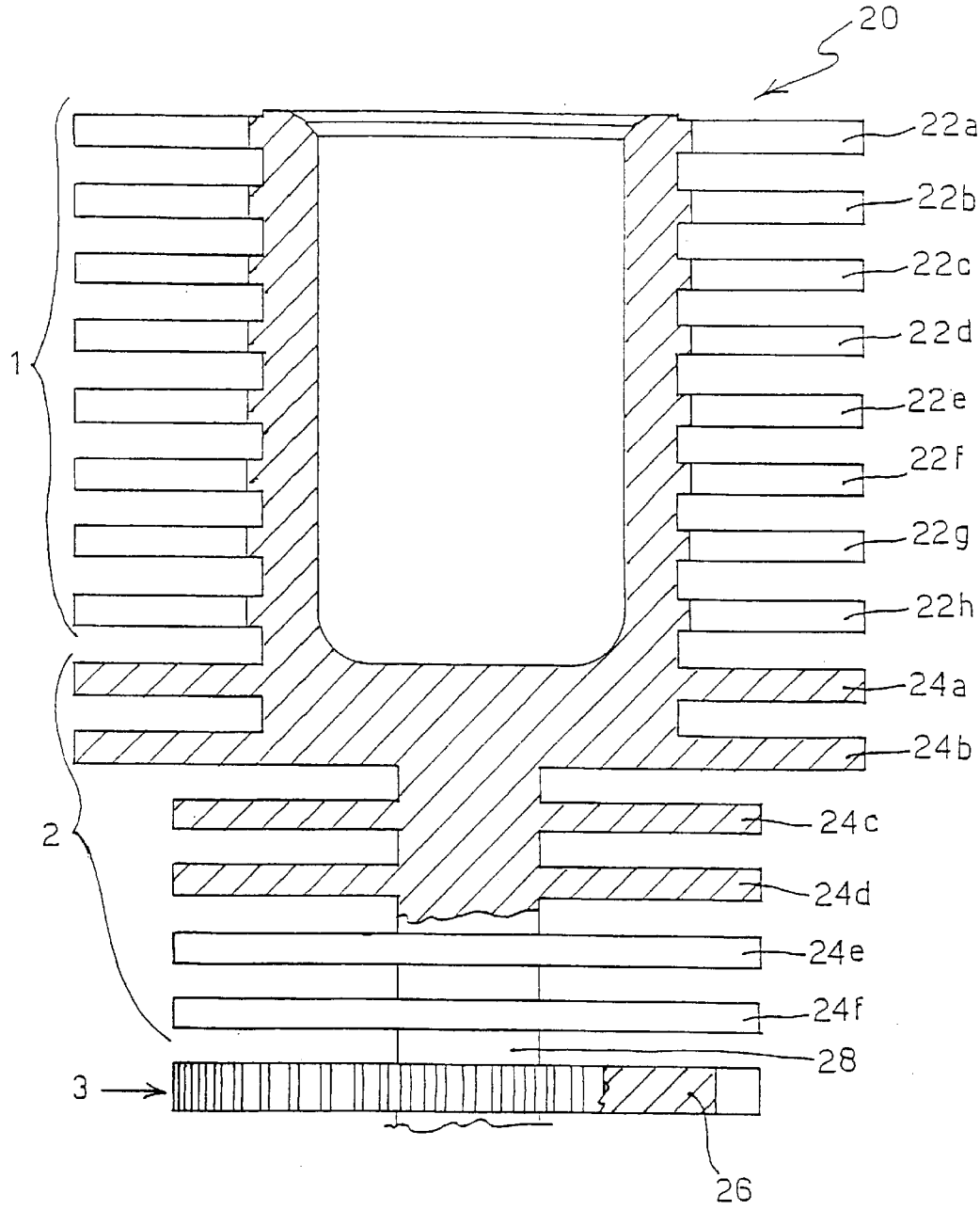
FIG. 2 is a cross sectional view of a pumping rotor of a turbomolecular vacuum pump made in accordance with the present invention.

FIG. 2 shows, in cross sectional view, the structure of rotor 20 of the turbomolecular pumping section. The first pumping group 1, including eight rotor discs 22*a*–22*h* with inclined blades, is provided on the pump side proximal to suction duct 6. The blade inclination progressively increases from the first rotor disc 22*a* to the last rotor disc 22*h* of this group.

Indeed, the blades of the first rotor disc 22*a* are inclined of about 45° relative to the rotational axis of the rotor, whereas the blades of the last rotor disc 22*h* are almost horizontal.

A second pumping group 2, axially aligned with the first pumping group and comprising six smooth rotor discs 24*a*–24*f*, is located below the first pumping stage. The first two smooth rotor discs 24*a* and 24*b* have the same diameter as the preceding bladed rotor discs, whereas the last four smooth rotor discs 24*c*–24*f* have smaller diameter.

A third pumping group 3 comprises a rotor disc 26 with straight teeth and is coupled with a stator ring 30. Rotor 20 further comprises a rotation shaft 28, integral with the rotor discs and driven by a suitable electric motor.

Figure 3:
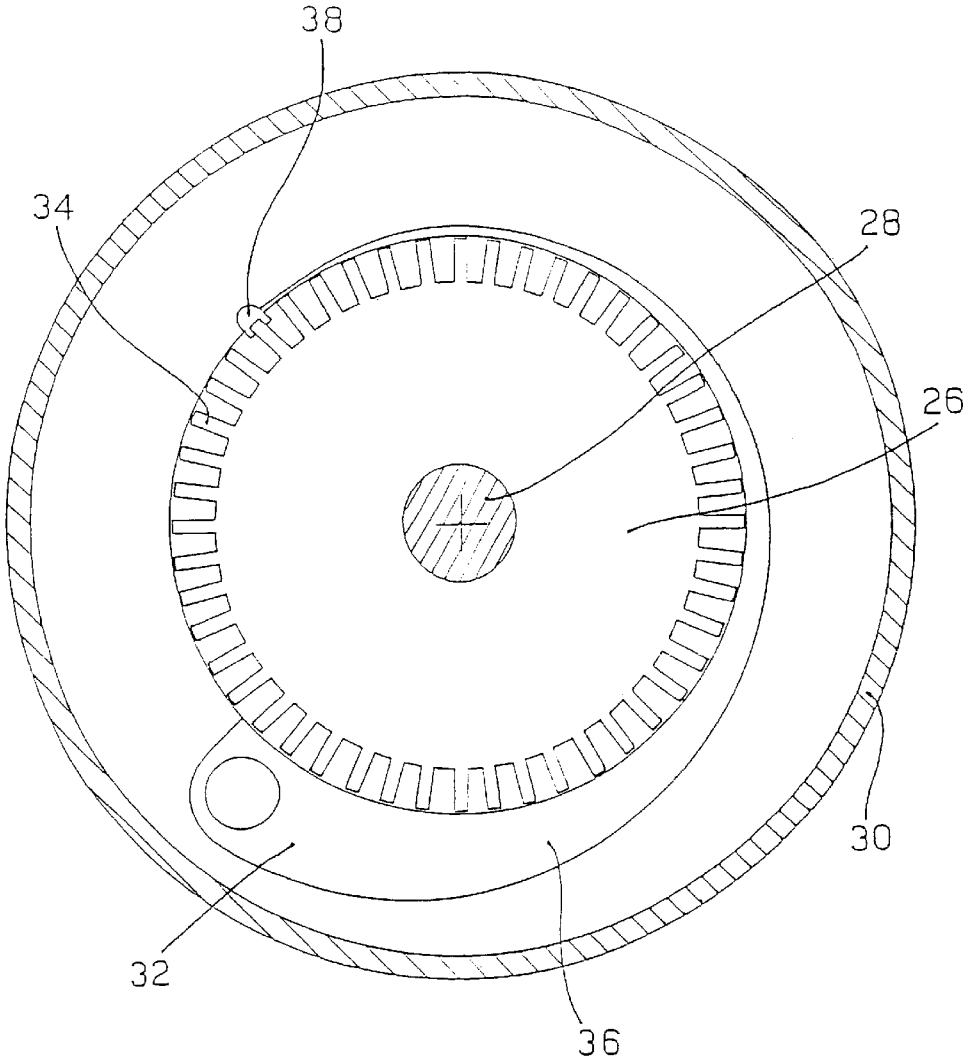
FIG. 3 is a plan view of a particular pumping stage of a turbomolecular vacuum pump made in accordance with the present invention.

The third pumping group 3 is shown in detail in FIG. 3. Rotor disc 26, equipped with a plurality of straight teeth 34, is spaced from stator ring 30 so as to form, between the side surface of rotor disc 26 and the inner circumferential surface of stator ring 30, a free and tapered annular channel 36.

Tapered channel 36 has a suction port and a discharge port located at opposite ends of channel 36 and defining a gas suction region 32 and a gas discharge region 38, respectively. A tapered groove in stator ring 30 forms channel 36 linearly tapered from suction region 32 towards discharge region 38. The transverse size of channel 36 progressively decreases from the suction port towards the discharge port, in counterclockwise direction, in circumferential direction about rotor disc 26.

Due to rotor 26 with straight teeth and to tapered channel 36, already the third pumping section is capable of exhausting at a pressure of about 100 mbar. However even if such pressure is very high, it does not yet allow a direct connection with the outside environment (i.e. the environment at atmospheric pressure).

Discharge region 38 of the third pumping section is thus connected, through an intermediate duct 8, visible in the diagrammatic overall view of vacuum pump 5 shown in FIG. 1*a*, to a fourth ejector or venturi pumping section 4. The fourth pumping section is fed, through a duct 14, by cooling water circuit 12 of the preceding turbomolecular pumping sections. Indeed, the pressurised cooling water enters pump 5 through an inlet duct 10, passes into cooling circuit 12 of turbomolecular sections 1, 2 and 3, and enters, via duct 14, the fourth ejector pumping section, shown in detail in FIG. 4.

Figure 1B:
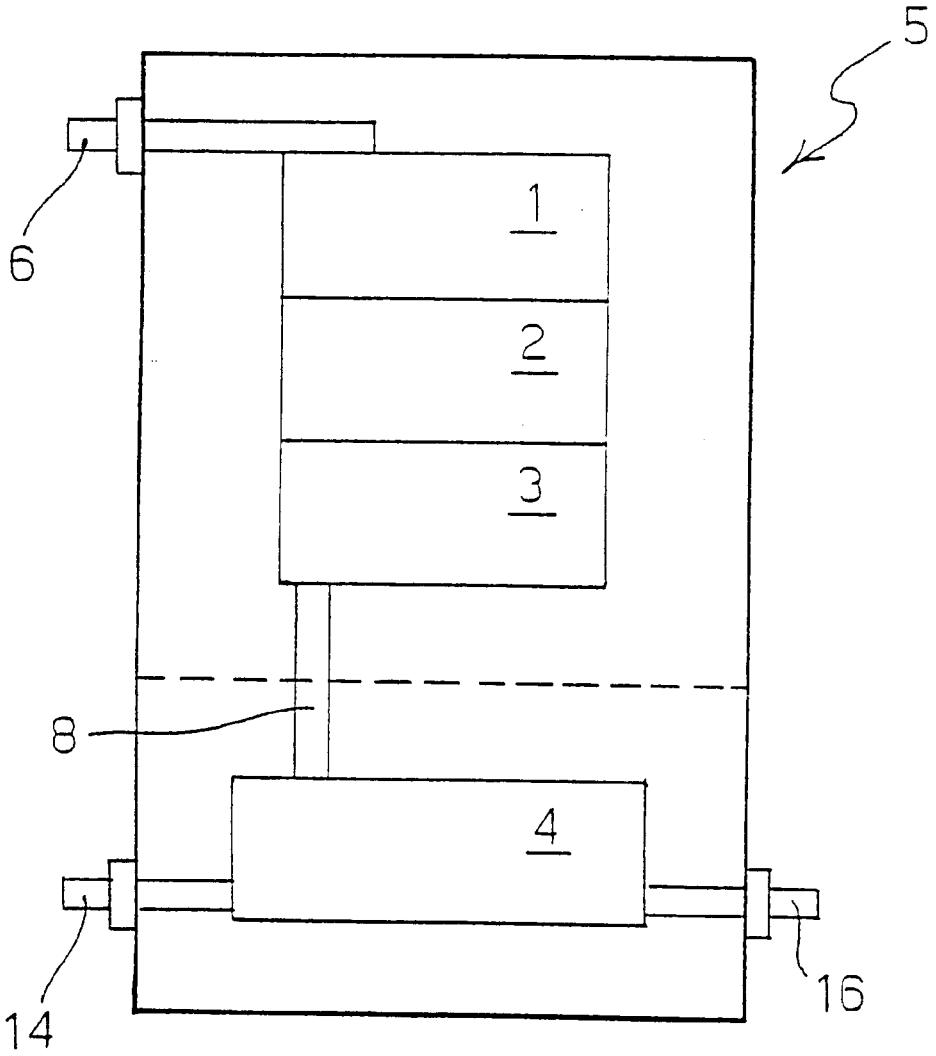
FIG. 1*b* is a schematical view of a turbomolecular vacuum pump made in accordance with a second embodiment of the present invention.

In the alternative embodiment, the fourth pumping section could be fed through a suitable hydraulic circuit, as in the exemplary embodiment shown in FIG. 1*b* in which the cooling circuit of stages 1, 2 and 3 of the turbomolecular pump is not provided, or when the cooling circuit pressure is not sufficient to actuate ejector pump 4.

FIG. 1*b* actually shows a vacuum pump in which the ejector or venturi pumping section 4 is fed by an independent external hydraulic circuit.

Figure 4:
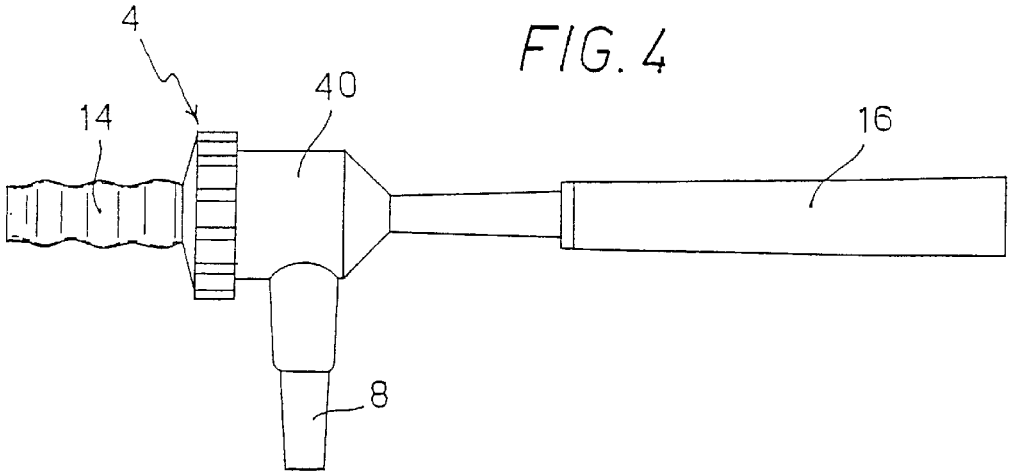
FIG. 4 is a side view of an ejector or venturi pumping section of a vacuum pump made in accordance with the present invention.

Ejector pumping section 4, shown in detail in FIG. 4, comprises an inlet 14 for pressurised water, a suction duct 8 connected to the outlet of the third pumping section 3, and an exhaust duct 16 from which driving water and sucked gases are exhausted in admixture, at atmospheric pressure.

Water passage in the ejector or venturi pump actually creates a vacuum in suction duct 8 allowing the pump to exhaust at atmospheric pressure.

The fourth pumping section 4, having neither moving parts nor electrically powered parts, has a number of advantages. It is not easily subject to failures, it does not require special maintenance and lubrication and does not consume electric power, exploiting the pressurised water coming from the cooling circuit of the turbomolecular sections. Moreover, thanks to its structural simplicity, it scarcely adds to the overall cost of the vacuum pump.

The absence of lubricated parts in that latter section 4 further reduces the possibility of polluting the environment where vacuum is generated.

The operation principle and the internal structure of an ejector or venturi pump, having inlet and outlet ducts with convergent and divergent cross sections, respectively, are known to those of average skill in the art. Those pumps are in effect included in different models and sizes in the catalogues, depending on the features and the required use.

The reduced power consumption of the pump, obtained through the use of an ejector pump as the fourth pumping section, is further favoured by the presence of the third pumping stage including a rotor disc with straight teeth. Indeed, at the exhaust pressure of 30 mbar it has been experienced that the pump with a toothed pumping stage has lower electric current absorption than a pump not equipped with a stage with toothed rotor disc.

What is claimed is:

1. A vacuum pump (5) comprising a plurality of pumping sections arranged between a suction duct (6) and an exhaust duct (16) and including at least one turbomolecular pumping section (1, 2, 3), characterised in that said pump comprises a pumping section (4) of the ejector or venturi pump type.

2. The vacuum pump (5) as claimed in claim 1, comprising a first pumping section (1) having pumping stages with bladed rotor discs (22*a*–22*h*), a second pumping section (2) having pumping stages with smooth rotor discs (24*a*–24*f*), a third pumping section (3) having at least one pumping stage with toothed rotor disc, and a fourth pumping section consisting of said pumping section (4) of the ejector or venturi pump type.

3. The vacuum pump (5) as claimed in claim 2, wherein said ejector pumping section (4) comprises a water-actuated venturi pump.

4. The vacuum pump (5) as claimed in claim 3, wherein said venturi pump includes an inlet duct (14) for pressurised water, a suction duct (8) connected with a discharge port of said third pumping section (3), and a discharge duct connected with said exhaust duct (16).

5. The vacuum pump (5) as claimed in claim 3, wherein said venturi pump is fed with water from a cooling circuit (12) of said at least one turbomolecular pumping section.

6. The vacuum pump (5) as claimed in claim 2, wherein said pumping stage with toothed rotor disc comprises a rotor (26) with straight teeth (34).

7. The vacuum pump (5) as claimed in claim 6, wherein said rotor (26) with straight teeth is coupled with a stator ring (30) and wherein a tapered free channel (36) is defined between said rotor (26) and said stator ring (30).

8. The vacuum pump (5) as claimed in claim 1, wherein said ejector pumping section (4) comprises a water-actuated venturi pump.

9. The vacuum pump (5) as claimed in claim 8, wherein said venturi pump is fed with water from a cooling circuit (12) of said at least one turbomolecular pumping section.

10. The vacuum pump (5) as claimed in any of the preceding claims, wherein said pumping sections (1, 2, 3, 4) form a single body.

* * * * *